US006511535B1

(12) United States Patent
Lacroix et al.

(10) Patent No.: US 6,511,535 B1
(45) Date of Patent: Jan. 28, 2003

(54) METHOD FOR PRINTING FIBROUS TEXTILE MATERIALS USING THE INK JET TECHNIQUE

(75) Inventors: Roger Lacroix, Village-Neuf (FR); Peter Scheibli, Binningen (CH); Mickael Mheidle, Sausheim (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/720,958

(22) PCT Filed: Jul. 5, 1999

(86) PCT No.: PCT/EP99/04648

§ 371 (c)(1),
(2), (4) Date: Jan. 3, 2001

(87) PCT Pub. No.: WO00/03082

PCT Pub. Date: Jan. 20, 2000

(30) Foreign Application Priority Data

Jul. 8, 1998 (CH) ..... 1455/98

(51) Int. Cl.[7] ..... C09D 11/00; D06P 5/00

(52) U.S. Cl. ..... 106/31.44; 106/31.49; 106/31.51; 106/31.5; 106/31.52; 106/31.58; 8/661; 8/664; 8/676; 8/680; 8/681; 8/682; 8/684; 8/128.1

(58) Field of Search ..... 106/31.44, 31.49, 106/31.5, 31.51, 31.52, 31.58; 8/661, 664, 675, 680, 681, 682, 684, 128.1

(56) References Cited

U.S. PATENT DOCUMENTS

| | | | | |
|---|---|---|---|---|
| 4,702,742 A | | 10/1987 | Iwata et al. | 8/495 |
| 5,847,740 A | * | 12/1998 | Yamamoto et al. | 347/101 |
| 6,153,263 A | * | 11/2000 | Haruta et al. | 427/261 |

FOREIGN PATENT DOCUMENTS

| | | |
|---|---|---|
| DE | 3543495 | 6/1986 |
| DE | 19527100 | 1/1997 |
| EP | 0212655 | 3/1987 |
| EP | 0583133 | 2/1994 |
| EP | 0605730 | 7/1994 |
| EP | 0631005 | 12/1994 |
| EP | 0633136 | 1/1995 |

OTHER PUBLICATIONS

Derwent Abstr. 97–100824/100 for DE 19527100, 1/97.

* cited by examiner

*Primary Examiner*—Helene Klemanski
(74) *Attorney, Agent, or Firm*—Kevin T. Mansfield

(57) ABSTRACT

The invention relates to a method for printing fibrous textile materials using the ink-jet printing technique, wherein the fibrous materials are printed with an aqueous ink that comprises at least one acid dye according to claim 1 and that has a viscosity of from 1 to 40 mPa·s.

8 Claims, No Drawings

METHOD FOR PRINTING FIBROUS TEXTILE MATERIALS USING THE INK JET TECHNIQUE

The present invention relates to a method for printing fibrous textile materials using the ink-jet printing technique.

Ink-jet printing processes have been used in the textile industry for some years. Such processes make it possible to dispense with the otherwise customary production of a printing screen, so that considerable savings can be made in terms of cost and time. Especially in the case of the production of pattern originals it is possible to respond to a change in requirements within a significantly shorter period of time.

Such ink-jet printing processes should especially have optimum characteristics from the standpoint of application technology. In this connection mention may be made of characteristics such as the viscosity, stability, surface-tension and conductivity of the inks used. Furthermore, higher demands are being made of the quality of the resulting prints, e.g. in respect of colour strength and fastness to wetting. Those demands are not met by the known processes in all characteristics, so that there is still a need for new processes for the ink-jet printing of textiles.

The present invention relates to a process for printing fibrous textile materials in accordance with the ink-jet printing technique wherein the fibrous materials are printed with an aqueous ink that comprises at least one acid dye and that has a viscosity of from 1 to 40 mPa·s.

Suitable acid dyes for the process according to the invention include, for example, the dyes described under "Acid Dyes" in the Colour Index, 3 rd edition (3rd revision 1987 inclusive Additions and Amendments up to No. 85). The anionic dyes that can be used may belong to a wide variety of dye classes and may contain one or more sulfonic acid groups. They include, for example, triphenylmethane dyes having at least two sulfonic acid groups, heavy-metal-free monoazo and disazo dyes each having one or more sulfonic acid groups, and heavy-metal-containing, namely copper-, chromium-, nickel- or cobalt-containing, monoazo, disazo, azomethine and formazan dyes, especially metallised dyes, that contain two molecules of azo dye, or one molecule of azo dye and one molecule of azomethine dye, bonded to a metal atom, especially such dyes containing mono- and/or dis-azo dyes and/or azomethine dyes as ligands and a chromium or cobalt ion as central atom, as well as anthraquinone dyes, especially 1-amino-4-arylaminoanthraquinone-2-sulfonic acids and 1,4-diarylamino- or 1-cycloalkylamino-4-arylaminoanthraquinonesulfonic acids.

There come into consideration as anionic acid dyes, for example:

a) triphenylmethane dyes of formula (1)

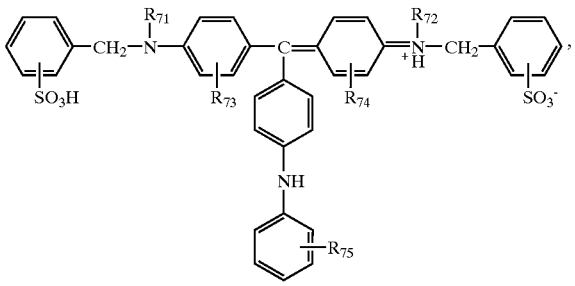

wherein $R_{71}$, $R_{72}$, $R_{73}$ and $R_{74}$ are each independently of the others $C_1$–$C_4$alkyl and $R_{75}$ is $C_1$–$C_4$alkyl, $C_1$–$C_4$alkoxy or hydrogen;

b) monoazo and disazo dyes of formulae (2)

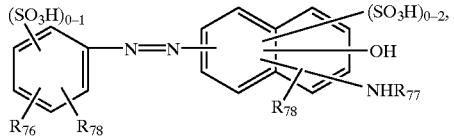

wherein $R_{76}$ is benzoylamino, phenoxy, chlorophenoxy, dichlorophenoxy or methylphenoxy, $R_{77}$ is hydrogen, benzoyl, phenyl, $C_1$–$C_4$alkyl, phenylsulfonyl or methylphenylsulfonyl, and the substituents $R_{78}$ are each independently of the other hydrogen or a phenylamino or N-phenyl-N-methylaminosulfonyl;

(3)

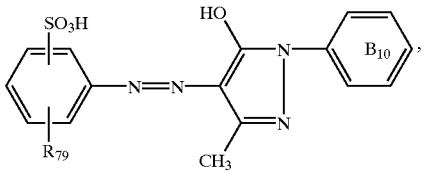

wherein the phenyl ring $B_{10}$ may be substituted by halogen, $C_1$–$C_4$alkyl and sulfo and $R_{79}$ is α-bromoacryloylamino;

(4)

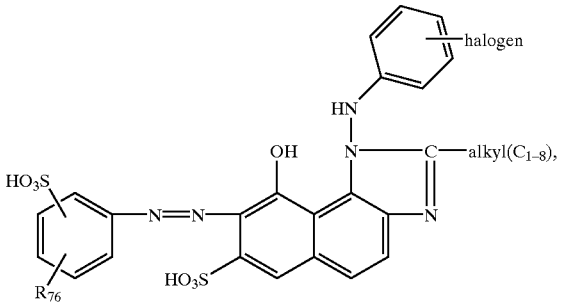

wherein $R_{76}$ has the meanings given above; and (5)

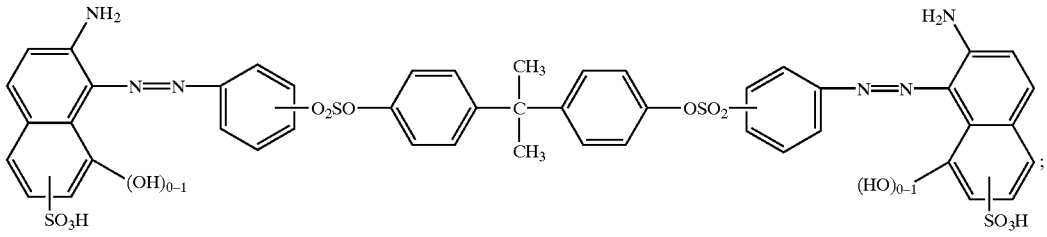

c) 1:2 metal complex dyes, such as the 1:2 chromium complex dyes of the azo and azomethine dyes of formulae (6)

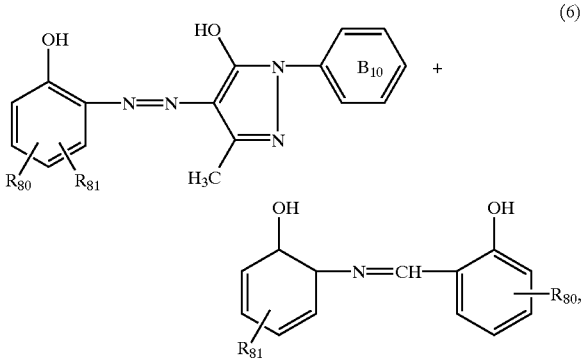

wherein $R_{80}$ is hydrogen, sulfo or phenylazo and $R_{81}$ is hydrogen or nitro, and the phenyl ring $B_{10}$ may be substituted by halogen, $C_1$–$C_4$alkyl and sulfo;

d) 1:2 metal complex dyes, such as the symmetric 1:2 chromium complex dyes of the azo dyes of formulae (7)

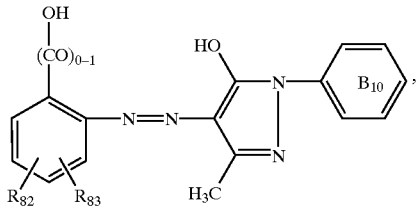

wherein the phenyl ring $B_{10}$ may be substituted by halogen, $C_1$–$C_4$alkyl and sulfo and $R_{82}$ and $R_{83}$ are each independently of the other hydrogen, nitro, sulfo, halogen, $C_1$–$C_4$alkylsulfonyl, $C_1$–$C_4$alkylaminosulfonyl or —$SO_2NH_2$; and (8)

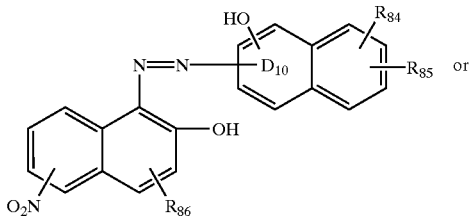

-continued

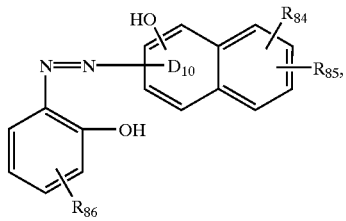

wherein $R_{84}$ is hydrogen, $C_1$–$C_4$alkoxycarbonylamino, benzoylamino, $C_1$–$C_4$alkylsulfonylamino, phenylsulfonylamino, methylphenylsulfonylamino or halogen, $R_{85}$ is hydrogen or halogen and $R_{86}$ is $C_1$–$C_4$alkylsulfonyl, $C_1$–$C_4$alkylaminosulfonyl, phenylazo, sulfo or —$SO_2NH_2$, the hydroxy group in the benzo ring $D_{10}$ being bound in the o-position relative to the azo group on the benzo ring $D_{10}$;

symmetric 1:2 cobalt complexes of the azo dyes of formulae (9)

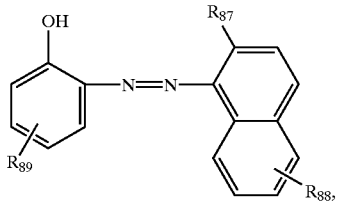

wherein $R_{87}$ is an —OH or —$NH_2$ group, $R_{88}$ is hydrogen or $C_1$–$C_4$alkylaminosulfonyl and $R_{89}$ is nitro or $C_1$–$C_4$alkoxy-$C_1$–$C_4$alkyleneaminosulfonyl, and (10)

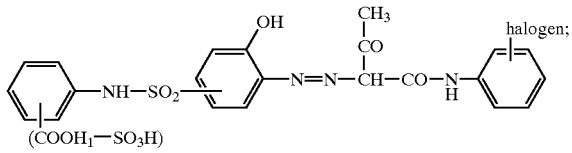

asymmetric 1:2 chromium complex dyes of the azo dyes of formulae
(11)
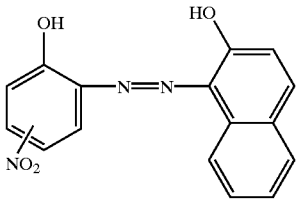
+
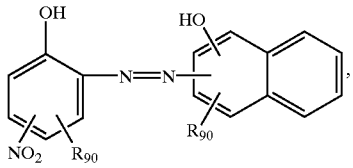
,
wherein
one substituent $R_{90}$ is hydrogen and the other is sulfo;
(12)
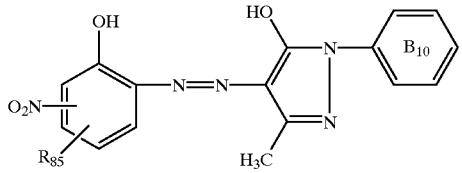
+
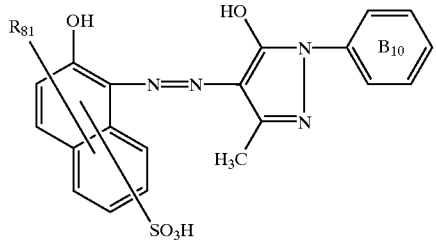
,
wherein
$R_{81}$ is hydrogen or nitro, the phenyl rings $B_{10}$ may be substituted by halogen, $C_1$–$C_4$alkyl and sulfo and $R_{85}$ is hydrogen or halogen; and
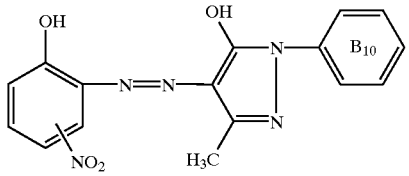
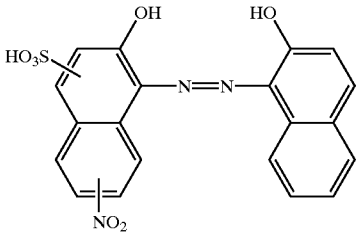
+
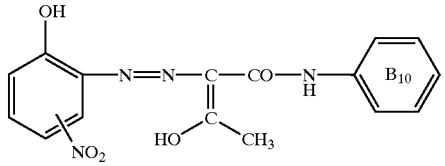
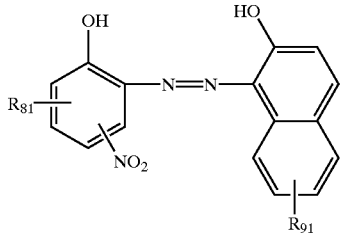
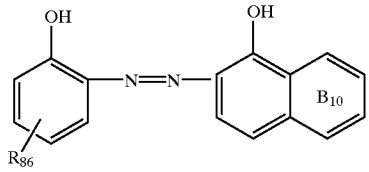
, wherein the phenyl ring $B_{10}$ may in each case be substituted by halogen, $C_1$–$C_4$alkyl and sulfo, $R_{81}$ is hydrogen or nitro, $R_{91}$ is hydrogen, methoxycarbonylamino or acetylamino and $R_{86}$ is $C_1$–$C_4$alkylsulfonyl, $C_1$–$C_4$alkylaminosulfonyl, phenylazo, sulfo or —$SO_2NH_2$;

1:2 chromium complex dyes of the azo dyes of formulae (7) and (8);

1:2 chromium mixed complexes of the azo dyes of formulae (7) and (8); and the copper complex of formula (14)

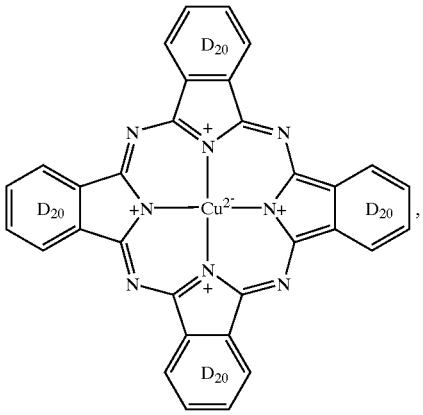

wherein the benzo rings $D_{20}$ are substituted by sulfo or by sulfonamido;

e) anthraquinone dyes of formulae (15)

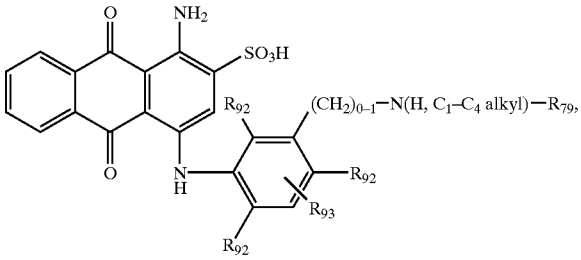

wherein $R_{79}$ is α-bromoacryloylamino, the substituents $R_{92}$ are each independently of the others hydrogen or $C_1$–$C_4$alkyl and $R_{93}$ is hydrogen or sulfo;

(16)

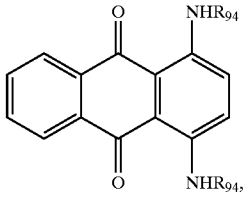

wherein the substituents $R_{94}$ are each independently of the other cyclohexyl or a diphenyl ether radical that may be substituted by sulfo and by the radical —$CH_2$—NH—$R_{79}$ in which $R_{79}$ has the meanings given above; and (17)

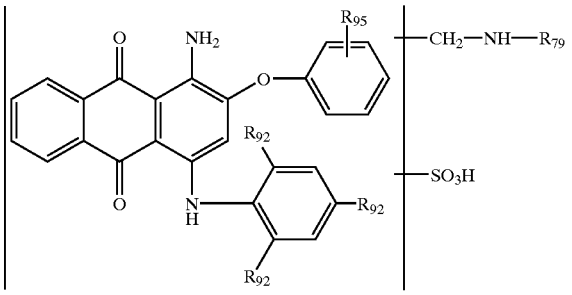

wherein $R_{79}$ is α-bromoacryloylamino, $R_{92}$ has the meanings given for formula (15) and $R_{95}$ is $C_4$–$C_8$alkyl;

f) metal-free anionic anthraquinone dyes of formulae (18)

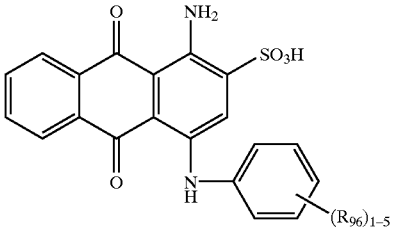

and (19)

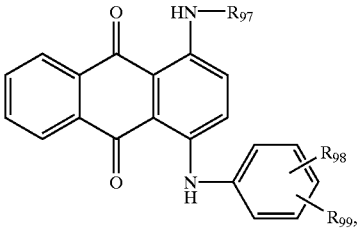

wherein $(R_{96})_{1-5}$ denotes from 1 to 5 identical or different substituents selected from the group $C_1$–$C_4$alkyl unsubstituted or substituted by $C_2$–$C_4$alkanoylamino (which may in turn be substituted in the alkyl group by halogen) or by benzoylamino; $C_1$–$C_4$alkoxy; $C_2$–$C_4$alkanoylamino and $C_2$–$C_4$hydroxyalkylsulfamoyl; $R_{97}$ is $C_1$–$C_4$alkyl, $C_5$–$C_7$cycloalkyl unsubstituted or substituted by $C_1$–$C_4$alkyl, or phenyl unsubstituted or substituted by phenoxy, $C_1$–$C_4$alkyl or by sulfo, the phenoxy group in turn being unsubstituted or substituted in the phenyl ring by $C_1$–$C_4$alkyl, $C_1$–$C_4$alkoxy, halogen or by sulfo, especially by $C_1$–$C_4$alkyl or by sulfo; $R_{98}$ and $R_{99}$ are each independently of the other $C_1$–$C_4$alkyl unsubstituted or substituted by $C_2$–$C_4$alkanoylamino (which may in turn be substituted in the alkyl group by halogen) or phenoxy unsubstituted or substituted in the phenyl ring by $C_1$–$C_4$alkyl, $C_1$–$C_4$alkoxy, halogen or by sulfo, especially by $C_1$–$C_4$alkyl or by sulfo; and g) monoazo dyes of formulae (20)

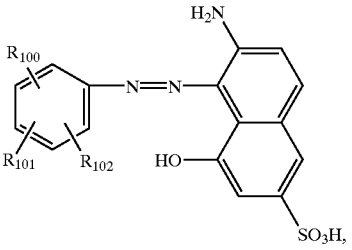

wherein $R_{100}$ is halogen, trifluoromethyl or

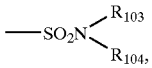

in which $R_{103}$ is cyclohexyl and $R_{104}$ is $C_1$–$C_4$alkyl, or the radicals $R_{103}$ and $R_{104}$, together with the nitrogen atom linking them, form an azepinyl ring; $R_{101}$ is hydrogen or halogen and $R_{102}$ is hydrogen or is phenoxy unsubstituted or substituted in the phenyl ring by halogen;

(21)

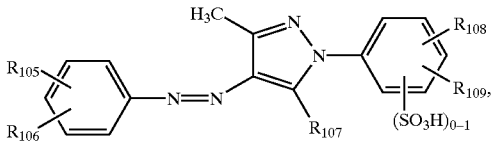

wherein $R_{105}$ is hydrogen, halogen or sulfo; $R_{106}$ is hydrogen; halogen; phenoxy or phenoxysulfonyl unsubstituted or substituted in the phenyl ring by $C_1$–$C_4$alkyl, $C_1$–$C_4$alkoxy or by halogen; or a radical of formula

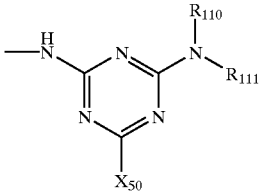

in which $R_{110}$ is phenyl unsubstituted or substituted by $C_1$–$C_4$alkyl, $C_1$–$C_4$alkoxy, halogen or by sulfo, $R_{111}$ is hydrogen or $C_1$–$C_4$alkyl and $X_{50}$ is halogen; $R_{107}$ is hydroxy or amino; and $R_{108}$ and $R_{109}$ are each independently of the other hydrogen or halogen;

(22)

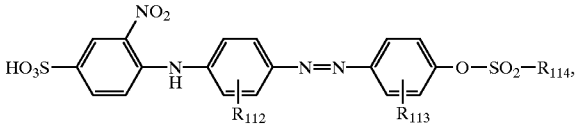

wherein $R_{112}$ and $R_{113}$ are each independently of the other hydrogen, $C_1$–$C_4$alkyl, $C_1$–$C_4$alkoxy, halogen or $C_2$–$C_4$alkanoylamino, preferably hydrogen or $C_1$–$C_4$alkyl, $R_{114}$ is phenyl unsubstituted or substituted by $C_1$–$C_4$alkyl, $C_1$–$C_4$alkoxy, halogen or by $C_2$–$C_4$alkanoylamino, preferably unsubstituted phenyl or phenyl substituted by $C_1$–$C_4$alkyl;

(23)

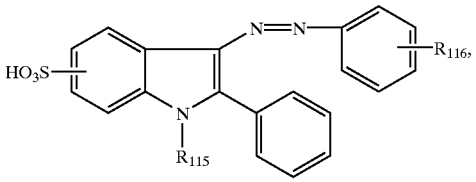

wherein $R_{115}$ is hydrogen or $C_1$–$C_4$alkyl, $R_{116}$ is hydrogen or phenylsulfonyl unsubstituted or substituted in the phenyl ring by $C_1$–$C_4$alkyl, $C_1$–$C_4$alkoxy, halogen or by $C_2$–$C_4$alkanoylamino, preferably unsubstituted phenylsulfonyl;

(24)

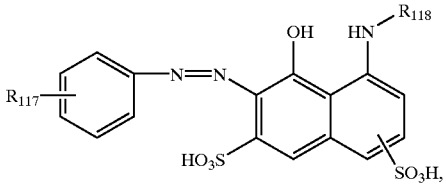

wherein $R_{117}$ is hydrogen, $C_1$–$C_4$alkyl, $C_1$–$C_4$alkoxy, halogen, or phenoxy unsubstituted or substituted in the phenyl ring by $C_1$–$C_4$alkyl, $C_1$–$C_4$alkoxy, sulfo, halogen or by $C_2$–$C_4$alkanoylamino, preferably unsubstituted phenoxy or phenoxy substituted by $C_1$–$C_4$alkyl or by halogen, and $R_{118}$ is benzoyl unsubstituted or substituted in the phenyl ring by $C_1$–$C_4$alkyl, $C_1$–$C_4$alkoxy, sulfo or by halogen, preferably unsubstituted benzoyl, or $C_2$–$C_4$alkanoyl unsubstituted or substituted in the alkyl group by hydroxy or by $C_1$–$C_4$alkoxy, preferably unsubstituted $C_2$–$C_4$alkanoyl, e.g. acetyl; and (25)

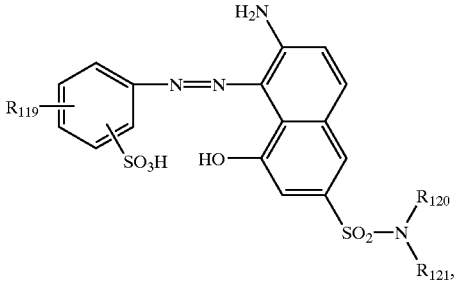

wherein $R_{119}$ is hydrogen, $C_1$–$C_4$alkyl, $C_1$–$C_4$alkoxy, halogen, or $C_2$–$C_4$alkanoylamino unsubstituted or substituted in the alkyl group by hydroxy, $C_1$–$C_4$alkoxy or by halogen; $R_{120}$ is phenyl unsubstituted or substituted by $C_1$–$C_4$alkyl, $C_1$–$C_4$alkoxy, sulfo or by halogen, preferably unsubstituted phenyl, and $R_{121}$ is hydrogen or $C_1$–$C_4$alkyl;

and disazo dyes of formulae (26)

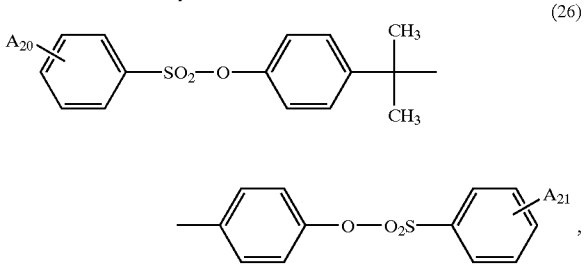

wherein $A_{20}$ and $A_2$, are radicals of formula (26a)

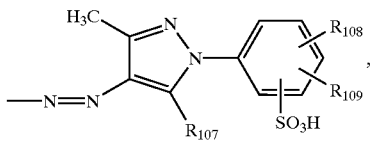

wherein $R_{107}$, $R_{108}$ and $R_{109}$, each independently of the others, has the meanings given above;

(27)
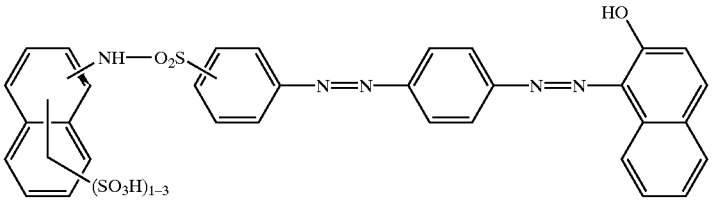
and
(28)
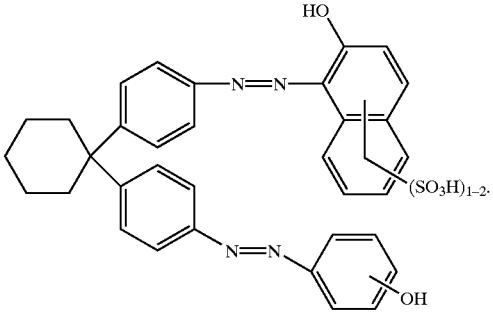
There are preferred as anionic acid dyes the dyes of formulae (5), (8), (14), (18), (26), (27) and (28).
Suitable metal-free anionic acid dyes are, for example, C.I. Acid Yellow 79, 110 and 246; C.I. Acid Orange 67 and 94; C.I. Acid Red 127,131, 252 and 361; C.I. Acid Green 40:1 and C.I. Acid Blue 225, 239, 260, 277 and 324 and also, especially, the dyes of formulae
(29)
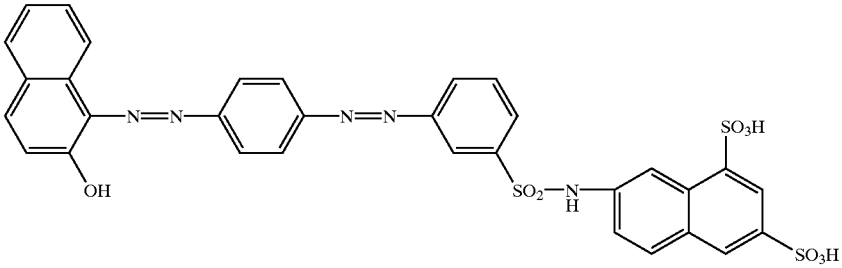
(30)
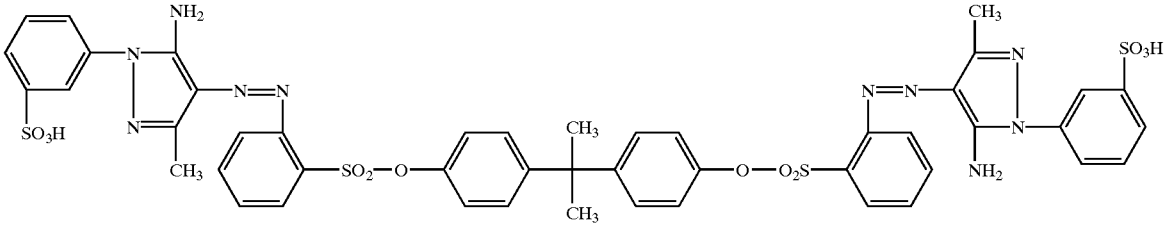
(31)
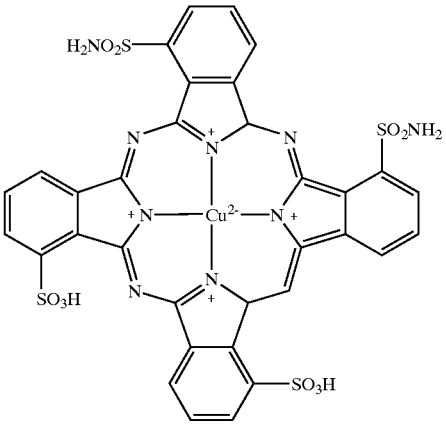

-continued
(32)
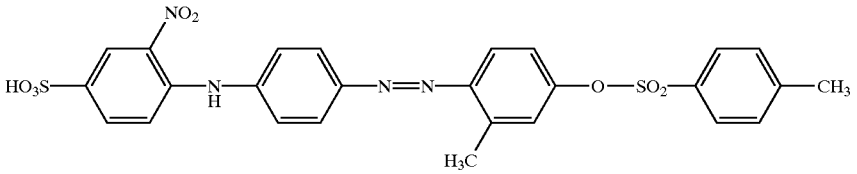
(33)
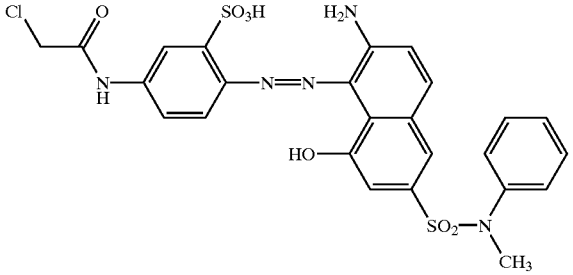
(34)
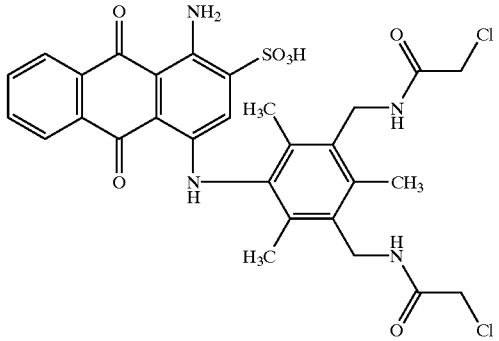
(35)
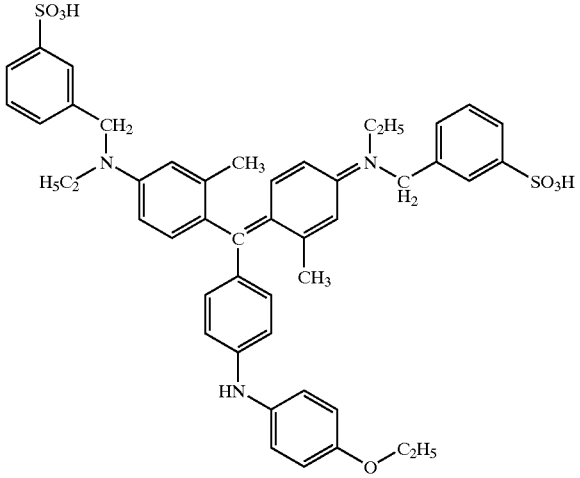
(36)
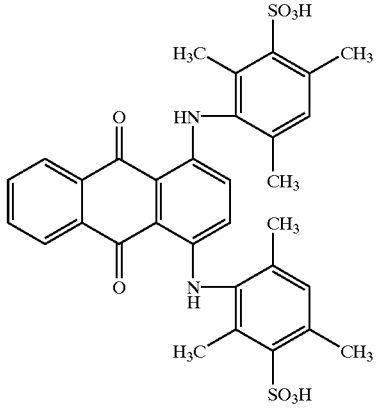
(37)
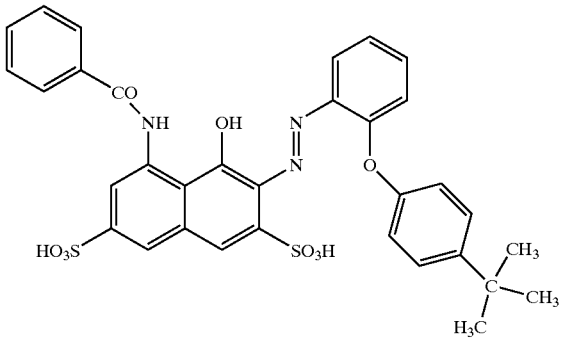
(38)
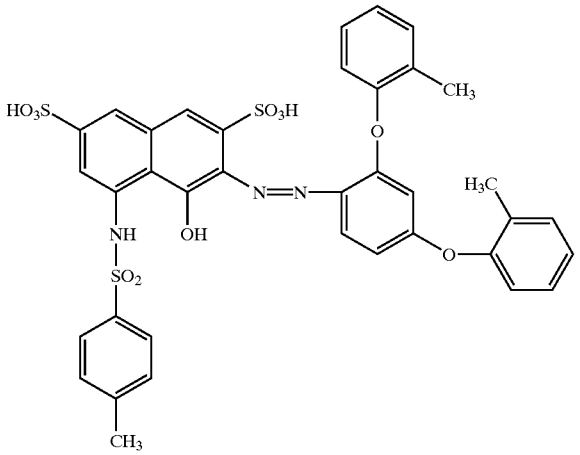

-continued
(39)
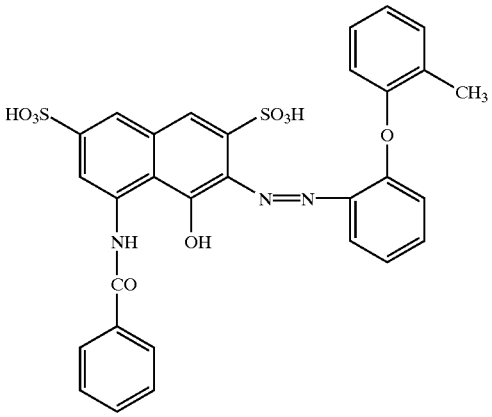
(40)
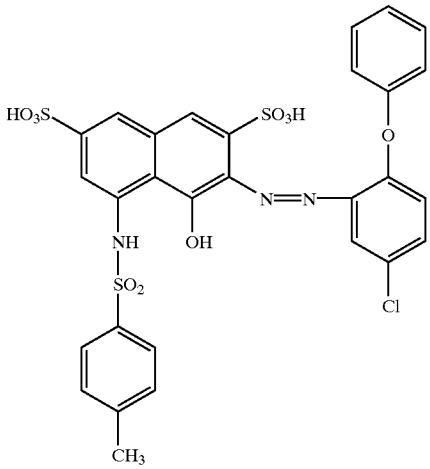
(41)
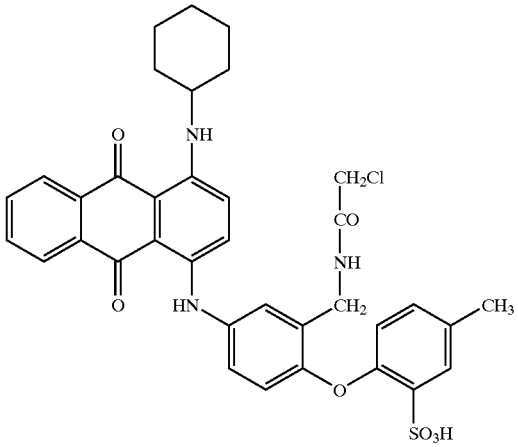
(42)
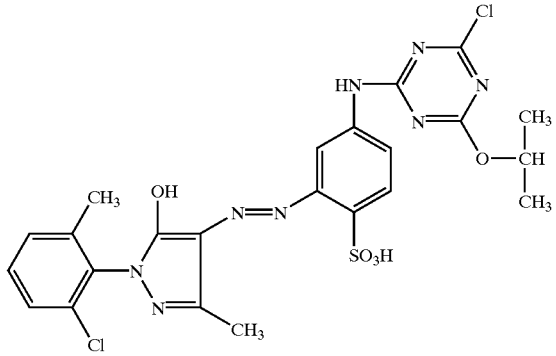
(43)
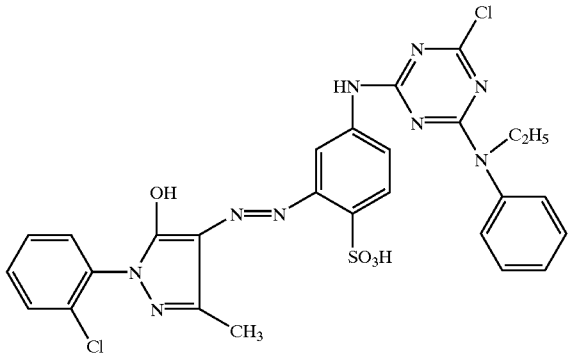
(44)
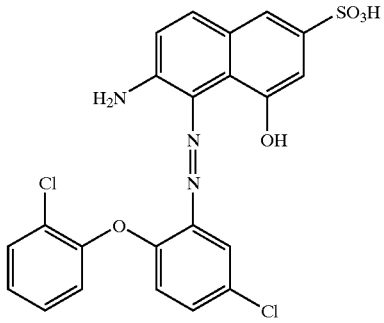
(45)
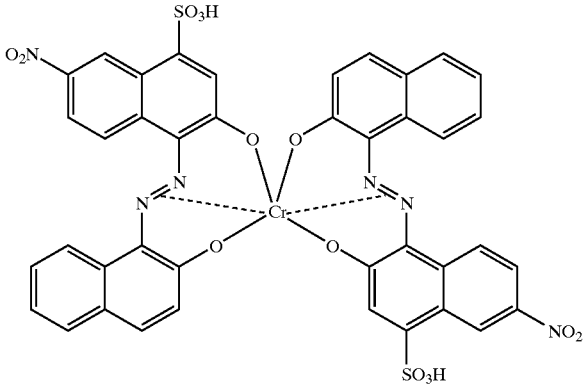

-continued
(46)
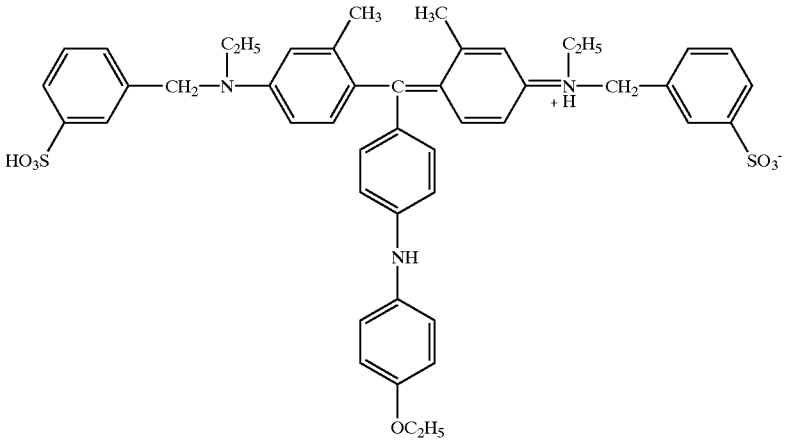
(47)
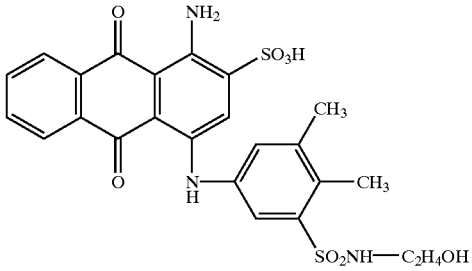
(48)
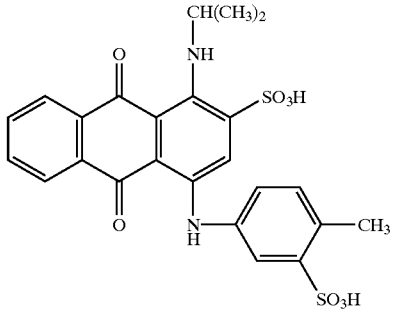
(49)
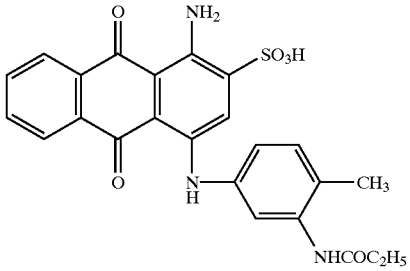
(50)
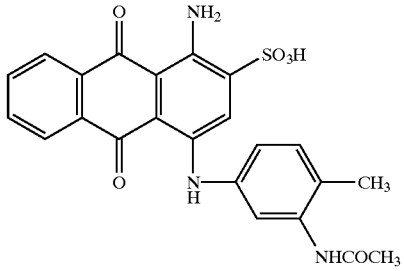
(51)
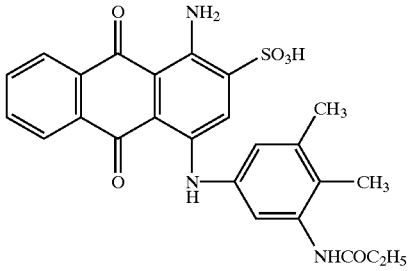
(52)
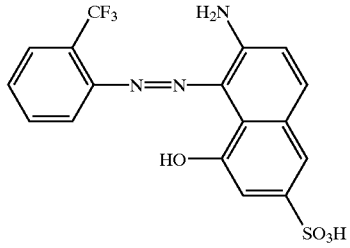

-continued
(53)
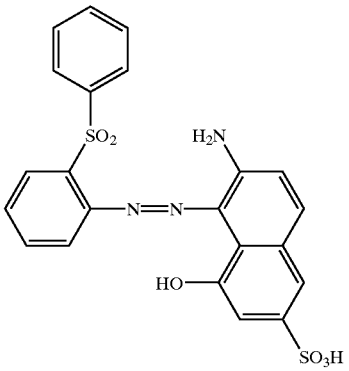
(54)
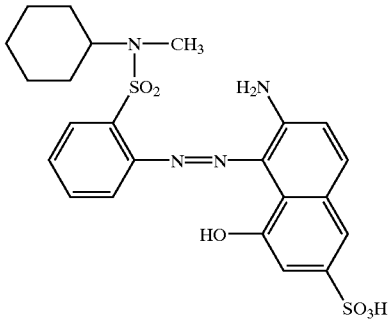
(55)
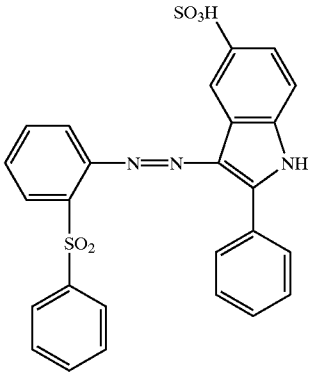
(56)
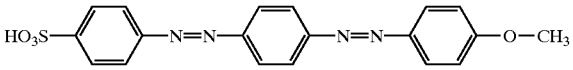
(57)
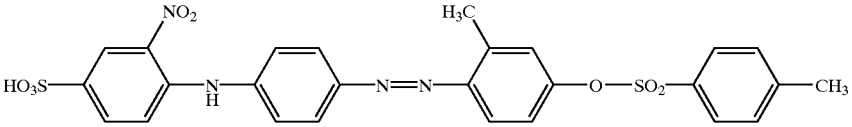
(58)
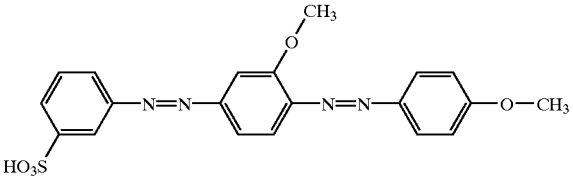
(59)
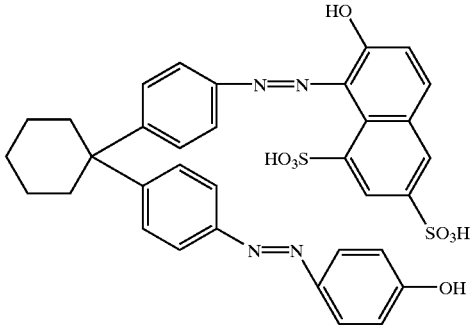
(60)
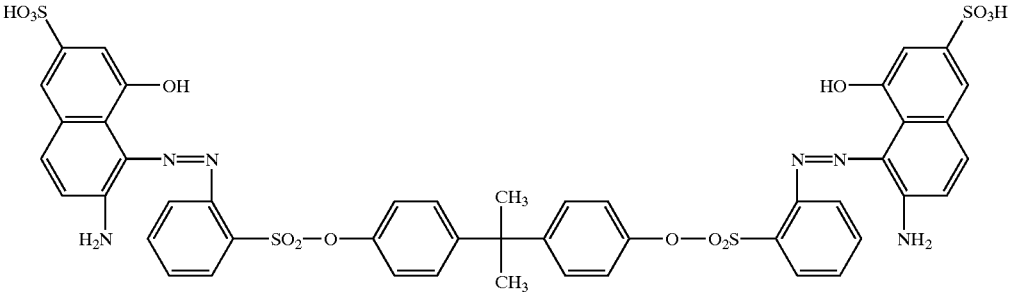

-continued (61)

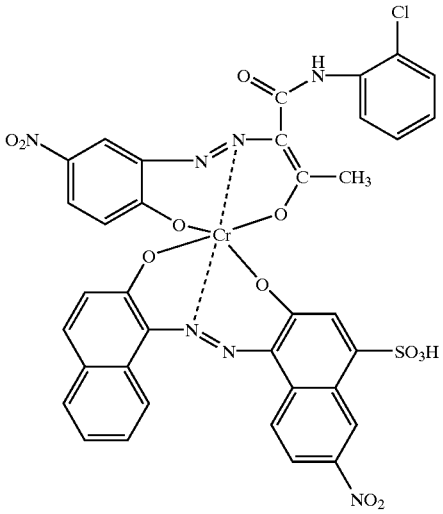

(62)

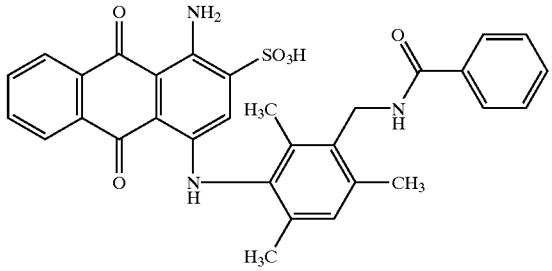

(63)

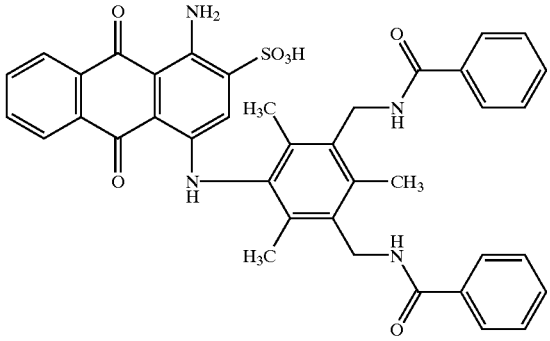

(64)

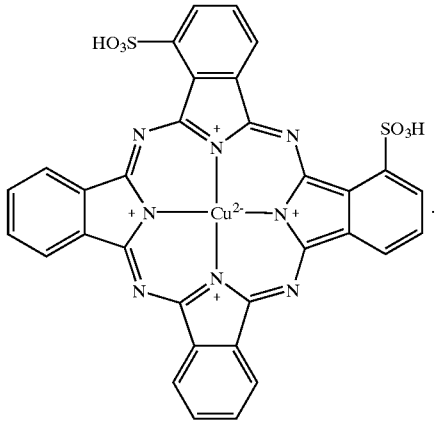

In the acid dyes of formulae (1) to (26), the radicals $R_{71}$ to $R_{121}$ have the following meanings: alkyl groups having from 1 to 4 carbon atoms, such as methyl, ethyl, propyl, isopropyl and butyl, it being possible for the alkyl radicals to be further substituted, e.g. by hydroxyl, sulfo or by sulfato; alkoxy groups having from 1 to 4 carbon atoms, such as methoxy, ethoxy, propoxy, isopropoxy and butoxy, it being possible for the alkyl radicals to be further subtituted, e.g. by hydroxyl, sulfo or by sulfato; halogen, such as fluorine, bromine and, especially, chlorine; $C_1$–$C_4$alkylsulfonyl, such as methylsulfonyl and ethylsulfonyl; $C_1$–$C_4$alkylaminosulfonyl, such as methylaminosulfonyl and ethylaminosulfonyl; $C_1$–$C_4$alkoxycarbonylamino, such as methoxycarbonylamino and ethoxycarbonylamino; $C_1$–$C_4$alkoxy-$C_1$–$C_4$alkyleneaminosulfonyl, such as methoxyethyleneaminosulfonyl; $C_2$–$C_4$alkanoylamino, such as propionylamino; $C_2$–$C_4$hydroxyalkylsulfamoyl, such as β-hydroxyethylsulfamoyl; $C_5$–$C_7$-cycloalkyl, such as cyclopentyl and cyclohexyl.

Of particular importance are the dyes of formulae (29), (30), (31), (45) and (59) to (64) and especially of formulae (29), (30), (31), (45), (59), (60) and (62) to (64).

The mentioned acid dyes are known or can be obtained analogously to known preparation procedures, such as disazotization, coupling, addition and condensation reactions.

The dyes used in the inks should preferably have a low salt content, that is to say they should have a total content of salts of less than 0.5% by weight, based on the weight of the dyes. Dyes that have relatively high salt contents as a result of their preparation and/or as a result of the subsequent addition of diluents can be desalted, e.g., by membrane separation procedures, such as ultrafiltration, reverse osmosis or dialysis.

The inks preferably have a total content of dyes of from 1 to 35% by weight, especially from 1 to 30% by weight and more especially from 1 to 20% by weight, based on the total weight of the ink. As a lower limit, a limit of 2.5% by weight, especially 5% by weight and more especially 7.5% by weight, is preferred.

Preferred for the process according to the invention are those inks having a viscosity of from 1 to 40 mPa·s (milliPascal-seconds), especially from 1 to 20 mPa·s and more especially from 1 to 10 mPa·s. Inks having a viscosity of from 1 to 6 mPa·s are of special importance. Also of importance are inks having a viscosity of from 10 to 30 mPa·s.

The inks may comprise thickeners of natural or synthetic origin, inter alia for the purpose of adjusting the viscosity.

Examples of thickeners that may be mentioned include commercially available alginate thickeners, starch ethers and locust bean flour ethers, especially sodium alginate on its own or in admixture with modified cellulose, especially in admixture with preferably from 20 to 25% by weight of carboxymethylcellulose. Synthetic thickeners that may be mentioned are, for example, those based on poly(meth) acrylic acids or poly(meth)acrylamides.

The inks comprise such thickeners, for example, in an amount of from 0.01 to 2% by weight, especially from 0.01 to 1% by weight and more especially from 0.01 to 0.5% by weight, based on the total weight of the ink.

The inks may also comprise buffer substances, e.g. borax, borates or citrates. Examples that may be mentioned include borax, sodium borate, sodium tetraborate, sodium hydrogen phosphate and also sodium citrate. They are used especially in amounts of from 0.1 to 3% by weight, especially from 0.1 to 1% by weight, based on the total weight of the ink, in order to establish a pH value of, for example, from 4 to 10, preferably from 5 to 8.

As further additives, the inks may comprise surfactants or humectants.

Suitable surfactants include commercially available anionic or non-ionic surfactants.

As humectants in the inks used in accordance with the invention there come into consideration, for example, urea, polyhydric alcohols, e.g. ethylene, diethylene, triethylene or tetraethylene glycol, 1,2-propylene glycol, dipropylene glycol, glycerol and polyethylene glycols having a molecular weight of preferably from 200 to 800, e.g. polyethylene glycol 200, and N-methyl-2-pyrrolidone.

If desired, the inks may also comprise acid donors, such as butyrolactone, or preservatives, substances that inhibit the growth of fungi and/or bacteria, antifoams, sequestering agents, emulsifiers, water-insoluble solvents, oxidising agents or air-releasing agents.

As preservatives there come into consideration formaldehyde-yielding agents, e.g. paraformaldehyde and trioxane, especially aqueous, for example 30 to 40% by weight formaldehyde solutions, imidazole compounds, e.g. 2-(4-thiazolyl)benzimidazole, thiazole compounds, e.g. 1,2-benzisothiazolin-3-one or 2-n-octyl-isothiazolin-3-one, iodine compounds, nitriles, phenols, haloalkylthio compounds and pyridine derivatives, especially 1,2-benzisothiazolin-3-one or 2-n-octyl-isothiazolin-3-one.

There come into consideration as sequestering agents, for example, nitrilotriacetic acid sodium salt, ethylenediaminetetraacetic acid sodium salt, especially sodium polymetaphosphate, more especially sodium hexametaphosphate; as emulsifiers especially adducts of an alkylene oxide and a fatty alcohol, more especially an adduct of oleyl alcohol and ethylene oxide; as water-insoluble solvents high-boiling, saturated hydrocarbons, especially paraffins having a boiling range of approximately from 160 to 210° C. (so-called white spirits); as oxidising agents, for example, an aromatic nitro compound, especially an aromatic mono-or di-nitro-carboxylic acid or -sulfonic acid, which is optionally present in the form of an alkylene oxide adduct, especially a nitrobenzenesulfonic acid; and as air-releasing agents, for example, high-boiling solvents, especially oils of turpentine, higher alcohols, preferably $C_8$- to $C_{10}$-alcohols, terpene alcohols, and air-releasing agents based on mineral and/or silicone oils, especially commercial formulations consisting of approximately from 15 to 25% by weight of a mineral oil and silicone oil mixture and approximately from 75 to 85% by weight of a $C_8$alcohol, such as 2-ethyl-n-hexanol. These are normally used in amounts of from 0.01 to 5% by weight, especially from 0.01 to 5% by weight, based on the total weight of the ink.

The inks preferably comprise N-methyl-2-pyrrolidone, diethylene glycol, glycerol or 1,2 propylene glycol, especially N-methyl-2-pyrrolidone, glycerol or 1,2-propylene glycol and more especially 1,2-propylene glycol, usually in an amount of from 2 to 30% by weight, preferably from 5 to 30% by weight and especially from 5 to 25% by weight, based on the total weight of the ink.

In a preferred embodiment, the inks used in accordance with the invention comprise urea or polyethylene glycol 200 in an amount of from 2 to 25% by weight, especially from 5 to 20% by weight.

The inks preferably also comprise solubilisers, e.g. ε-caprolactam in an amount of from 2 to 25% by weight, especially from 5 to 20% by weight, based on the total weight of the ink.

Preference is given to a process wherein the inks comprise a) at least one acid dye of formulae (5), (8), (14), (18), (26), (27) and (28) and b) 1,2-propylene glycol, N-methyl-2-pyrrolidone or glycerol.

Preference is given especially to a process wherein the inks comprise a) at least one acid dye of formulae (5), (8), (14), (18), (26), (27) and (28), b) 1,2-propylene glycol, N-methyl-2-pyrrolidone or glycerol and c) at least one compound from the group E-caprolactam, urea and polyethylene glycol 200.

In a further preferred embodiment of the process according to the invention, the inks comprise a) at least one acid dye of formulae (5), (8), (14), (18), (26), (27) and (28) and b) ε-caprolactam.

The inks can be prepared in customary manner by mixing the individual constituents together in the desired amount of water.

The process according to the invention for printing fibrous textile materials can be carried out using ink-jet printers suitable for textile printing that are known per se.

In ink-jet printing, individual droplets of ink are sprayed onto a substrate in a controlled manner from a nozzle. For this purpose, predominantly the continuous inkjet method and the drop-on-demand method are used. In the continuous inkjet method, the droplets are produced continuously and any droplets not required for the printing are conveyed to a collecting vessel and recycled, whereas in the drop-on-demand method droplets are produced and printed as required; that is to say droplets are produced only when required for the printing. The production of the droplets can be effected, for example, by means of a piezo ink-jet head or by means of thermal energy (bubble jet). For the process according to the invention, printing by means of a piezo ink-jet head is preferred. Also preferred for the process according to the invention is printing in accordance with the continuous ink-jet method.

Fibrous textile materials that come into consideration are especially nitrogen-containing or hydroxyl-group-containing fibrous materials, e.g. fibrous textile materials of cellulose, silk or, especially, wool or synthetic polyamides.

The process according to the invention is used especially preferably to print silk or silkcontaining mixed fibrous material. As silk there come into consideration not only natural silk and cultured silk (mulberry silk, Bombyx mori) but also the various wild silks, especially tussah silk, and also eria and fagar silks, slub silk, Senegal silk, muga silk, and also mussel silk and spider silk. Silk-containing fibrous materials are especially blends of silk with polyester fibres, acrylic fibres, cellulose fibres, polyamide fibres or with wool. The said textile material can be in a wide variety of processing forms, e.g. in the form of fibres, yarn, or woven or knitted fabrics.

For printing silk or silk-containing fibrous material, the fibrous material is preferably subjected to a pretreatment. To that end the fibrous material is pretreated with an aqueous liquor comprising a thickener and, where appropriate, a hydrotropic agent. The thickeners preferably employed are alginate thickeners, such as commercially available sodium alginate thickeners, which are used, for example, in an amount of from 50 to 200 g/l of liquor, preferably from 100 to 200 g/l of liquor. The hydrotropic agent preferably employed is urea, which is used, for example, in an amount of from 25 to 200 g/l of liquor, preferably from 25 to 75 g/l of liquor. The liquor may in addition comprise further ingredients, e.g. ammonium tartrate. The liquor is preferably applied to the fibrous material according to the pad-dyeing method, especially with a liquor pick-up of from 70 to 100%. Preferably, the fibrous material is dried after the above pretreatment.

It is also possible in accordance with the process of the invention to use natural or synthetic fibrous polyamide materials. There comes into consideration as natural fibrous polyamide material especially wool. There come into consideration as synthetic fibrous polyamide material, for example, fibrous polyamide-6 and polyamide-66 materials.

After printing, the fibrous material is dried if necessary, preferably at temperatures of up to 150° C., especially from 80 to 120° C., and then subjected to a heat-treatment procedure in order to complete the printing, that is to say to fix the dye.

The heat treatment can be effected, for example, using a hot batch process, a thermosol process or, preferably, a steaming process.

In the steaming process, the printed fibrous material is subjected, for example, to treatment in a steamer with steam which is optionally superheated, e.g. at a temperature of from 95 to 180° C., advantageously at from 95 to 130° C., especially using saturated steam.

The printed fibrous material is then usually washed off with water in customary manner.

Both the ink-jet printing and the subsequent drying and fixing can also be carried out in a single step, which means, especially, that those steps are carried out continuously, that is to say, apparatuses for the inkjet printing, the drying and the fixing are mounted one after another and the fibrous material to be printed is moved through them continuously. The apparatuses for the ink-jet printing, the drying and the fixing can also be combined in a single machine. The fibrous material is transported continuously through the machine and is thus in the finished state when it leaves the machine. The drying can be effected, for example, by means of thermal energy (as indicated above for example) or especially by means of infrared radiation (IR). The fixing can be effected, for example, by means of ultraviolet radiation (UV) or by means of thermal energy (as indicated above for example). It will be understood that the ink-jet printing can also be carried out separately and the drying and fixing performed continuously as indicated above, e.g. in a single machine.

Using the printing processes indicated above it is possible to print fibrous materials either in a single shade or in a variety of shades. When the printing is in one shade, the fibrous material can be printed over the entire surface or with a pattern. The use of a single ink is, of course, sufficient for that purpose, but the desired shade can also be created by printing with a plurality of inks of different shades. When the fibrous material is to receive a print having a plurality of different shades, the fibrous material can either be printed with a plurality of inks that each have the desired shade or printed in such a manner that the shade in question is created (for example by printing the fibrous material with inks of different shades one on top of another, thus producing the required shade).

It is also possible to print a sheet-form fibrous material on both sides. In that case, for example, one side of the fibrous material can be printed in one shade, e.g. over the entire surface, and the other side of the fibrous material is printed with a pattern in one or more different shades. It will be understood that, in principle, that other side can likewise be printed in one shade over its entire surface. Such a process can be carried out, for example, by having one or more print heads arranged on each side of the sheet-form fibrous material to be printed. Both sides of the fibrous material are thus printed simultaneously. The print heads on each side of the fibrous material can be arranged either directly opposite one another or laterally displaced with respect to one another. The fibrous material is usually moved along between the print heads. Using this embodiment it is possible to achieve interesting effects, which are visible especially when the sheet-form fibrous material is folded over.

A further interesting embodiment relates to so-called "imaging", in which an original, that is to say an image that is to be reproduced by the print, is digitised, for example by means of a video camera or a scanner. The digitised image is transferred to a computer, which then prints the image onto the fibrous material by means of an inkjet printer. Of course, the digitised image may already be stored in the computer, so that digitisation is unnecessary. For example, an image to be printed may already have been created on the computer using graphics software. The image to be printed may also be, for example, letters, numbers, words, all kinds of patterns and also complex multi-coloured images. Multi-coloured images can be created, for example, by using a plurality of inks of different shades.

The prints obtainable by the process according to the invention exhibit good all-round properties; for example they exhibit good fastness to light, good wet-fastness properties, such as fastness to water, to washing, to seawater, to crossdyeing and to perspiration, good fastness to chlorine, fastness to rubbing, fastness to hot pressing and fastness to pleating, as well as sharp outlines and high colour strength. The printing inks used are distinguished by good stability and by good viscosity characteristics.

The following Examples serve to illustrate the invention. Unless otherwise indicated, the temperatures are given in degrees Celsius, parts are parts by weight and percentages relate to percent by weight. Parts by weight relate to parts by volume in a ratio of kilograms to litres.

EXAMPLE 1 a) A silk fabric is pad-dyed with an aqueous liquor (liquor pick-up 90%) containing 150 g/l of a commercially available alginate thickener, 50 g/l of urea and 50 g/l of an aqueous ammonium tartrate solution (25%) and dried.

b) A silk fabric is pad-dyed with an aqueous liquor (liquor pick-up 90%) containing 270 g/l of a commercially available low-molecular-weight alginate thickener, 150 g/l of urea and 50 g/l of an aqueous ammonium tartrate solution (25%) and dried.

c) Using a drop-on-demand piezo ink-jet head, an ink A containing 5% by weight of the dye of formula

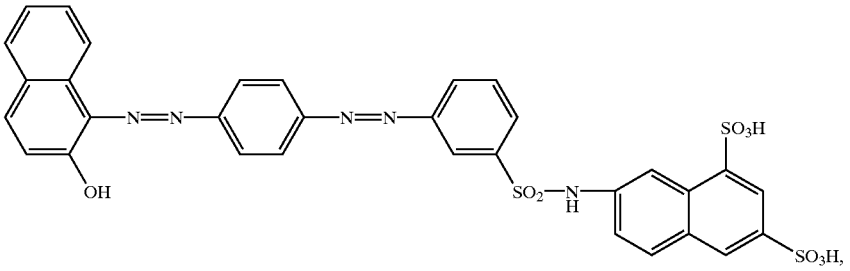

20% by weight of 1,2-propylene glycol and 75% by weight of water is used to print the silk fabric pretreated in accordance with a). The print is dried and fixed in saturated steam at 102° C. and is then washed off, yielding a red print having good all-round properties.

d) Using a drop-on-demand piezo ink-jet head, an ink A according to c) is used to print the silk fabric pretreated in accordance with b). The print is dried and fixed in saturated steam at 102° C. and is then washed off, yielding a red print having good all-round properties and especially sharp outlines.

EXAMPLES 2 TO 36

Prints having good all-round properties are likewise obtained by proceeding as in Example 1 but using, instead of 5% by weight of the dye indicated therein, an identical amount of one of the dyes listed in the following Table 1.

TABLE 1

| Example | dye |
|---|---|
| 2 | 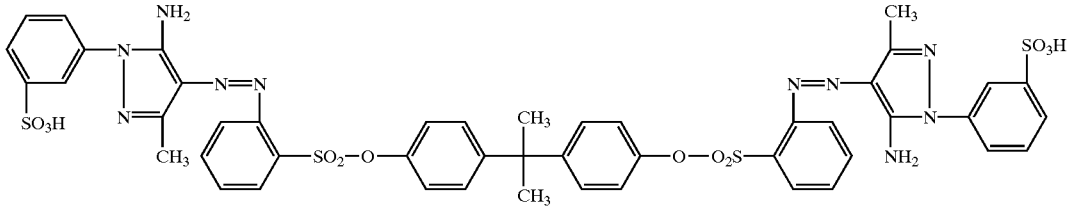 |
| 3 | 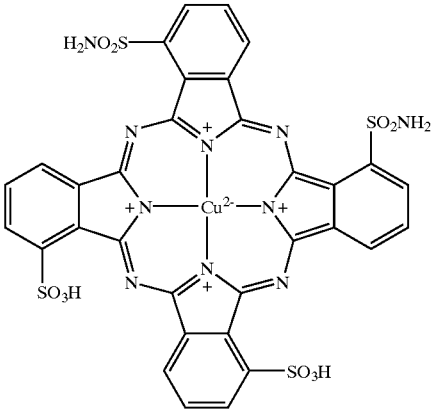 |
| 4 | 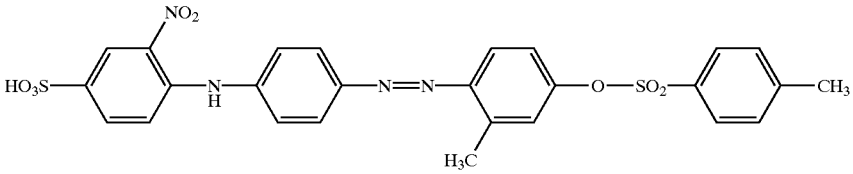 |

TABLE 1-continued
| Example | dye |
|---|---|
| 5 | 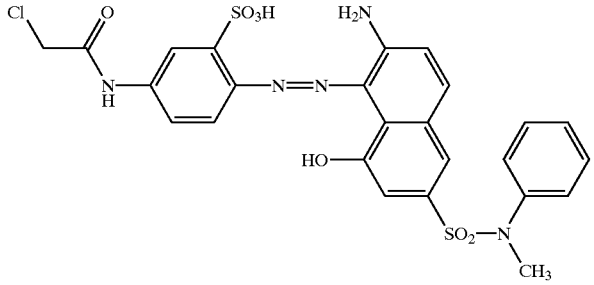 |
| 6 | 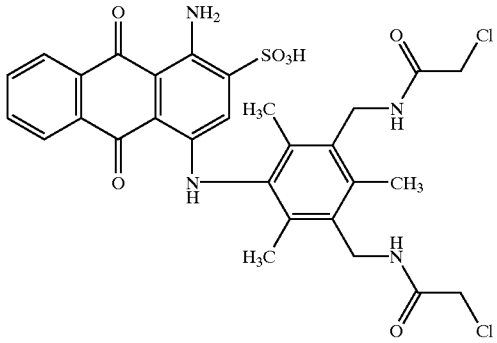 |
| 7 | 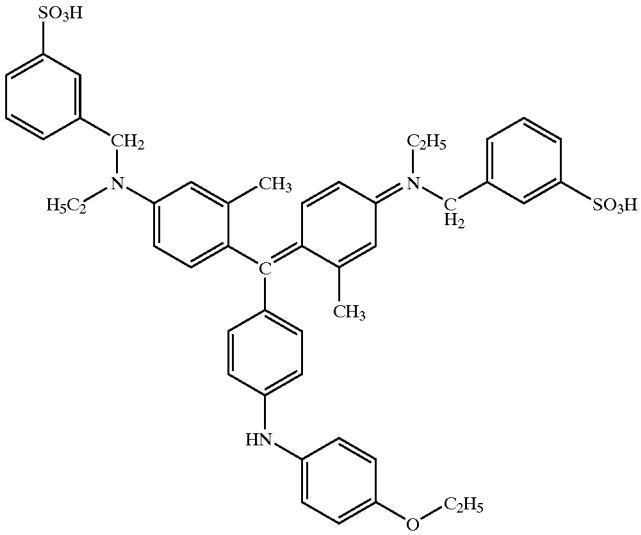 |
| 8 | 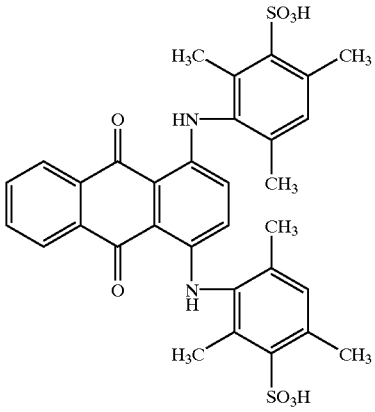 |

TABLE 1-continued
| Example | dye |
|---|---|
| 9 | 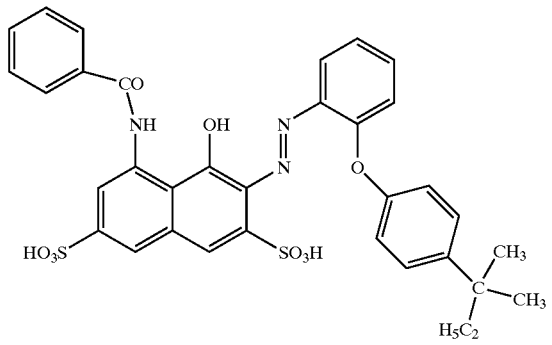 |
| 10 | 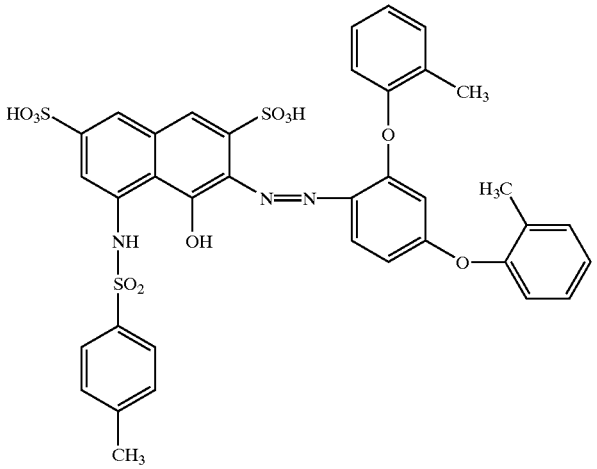 |
| 11 | 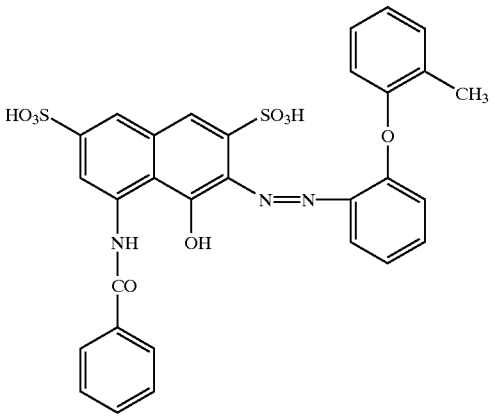 |

TABLE 1-continued
| Example | dye |
|---|---|
| 12 | 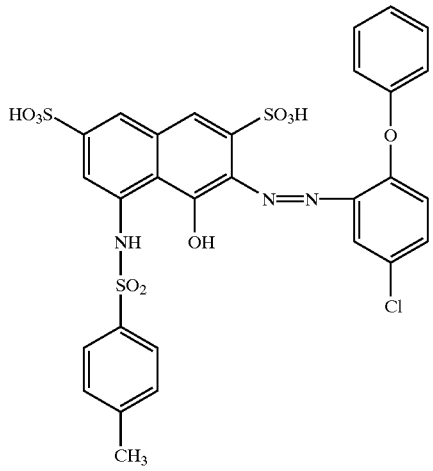 |
| 13 | 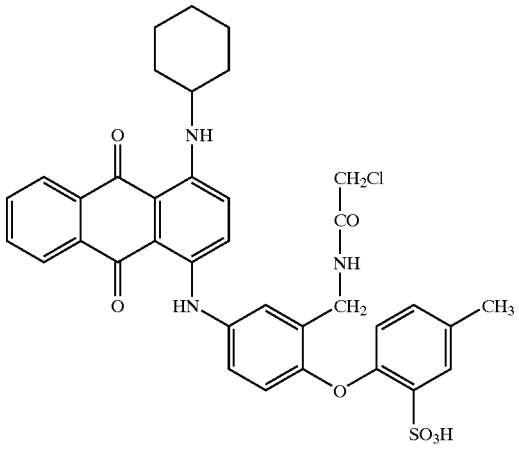 |
| 14 | 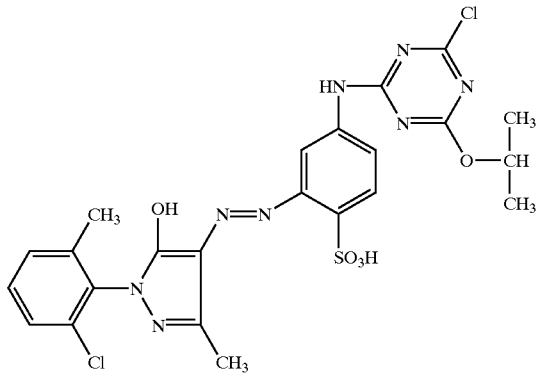 |

TABLE 1-continued
| Example | dye |
|---|---|
| 15 | 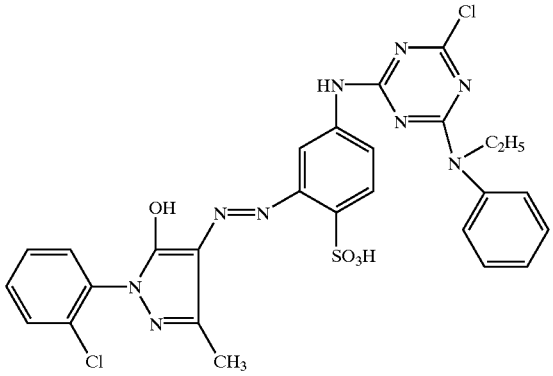 |
| 16 | 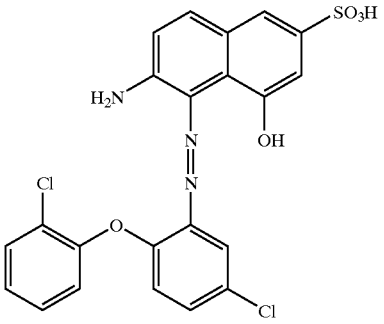 |
| 17 | 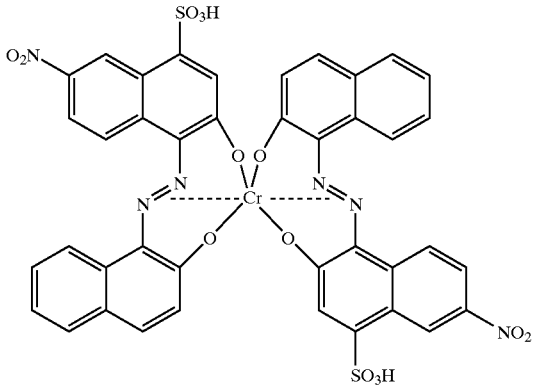 |
| 18 | 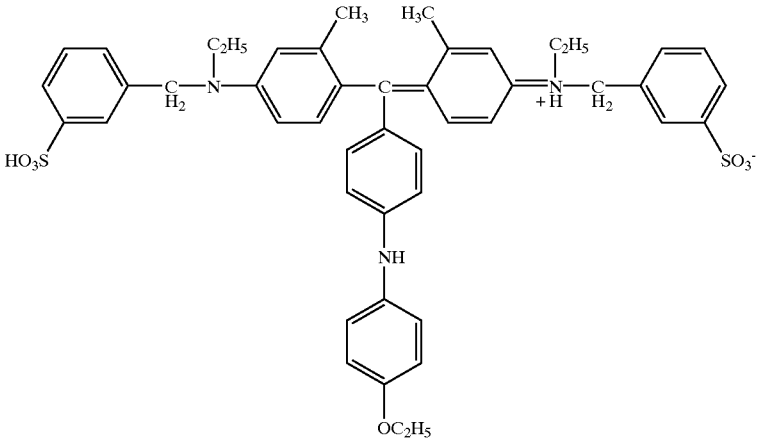 |

TABLE 1-continued
| Example | dye |
|---|---|
| 19 | 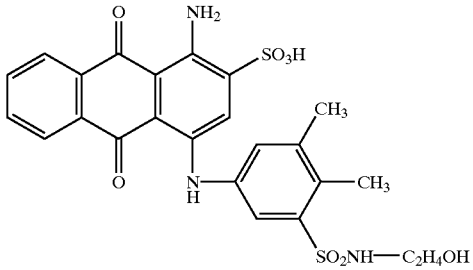 |
| 20 | 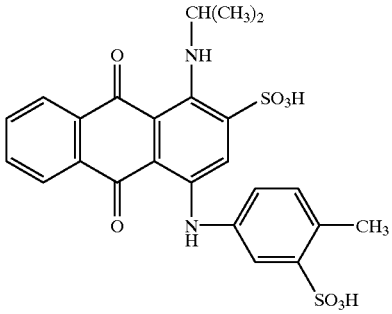 |
| 21 | 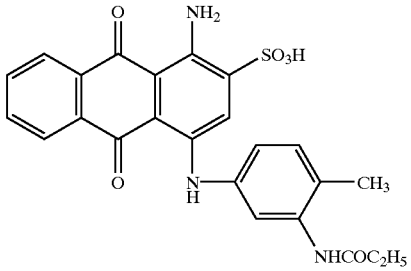 |
| 22 | 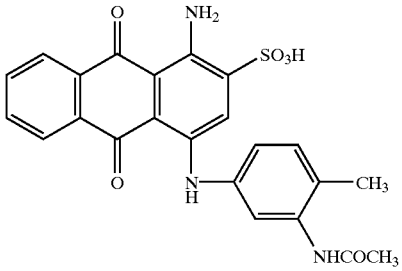 |
| 23 | 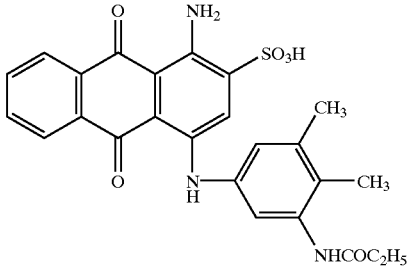 |

TABLE 1-continued
| Example | dye |
|---|---|
| 24 | 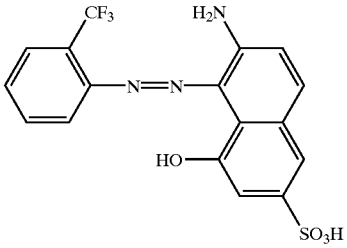 |
| 25 | 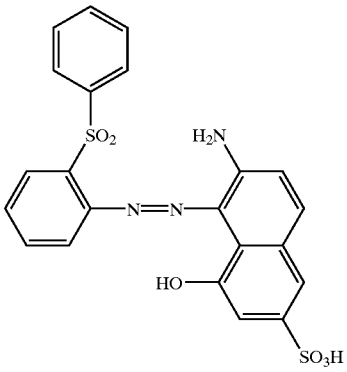 |
| 26 | 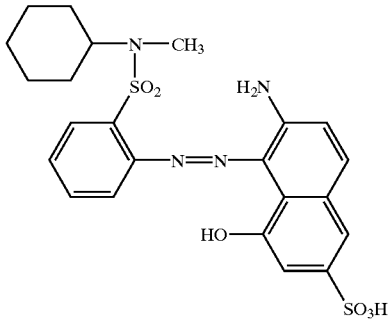 |
| 27 | 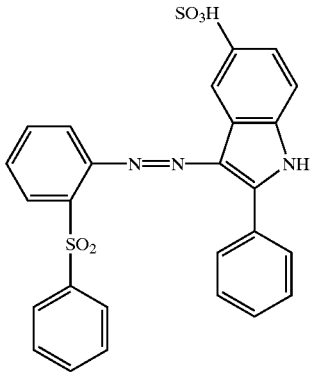 |
| 28 | 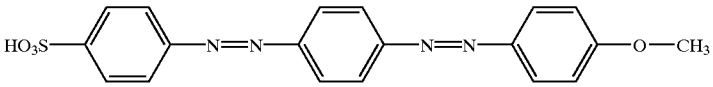 |
| 29 | 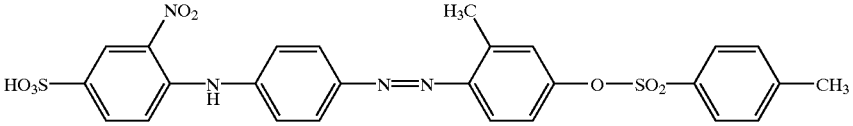 |

TABLE 1-continued
| Example | dye |
|---|---|
| 30 | 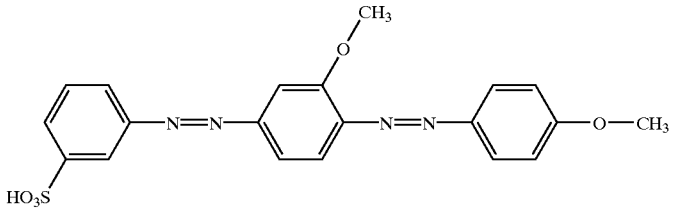 |
| 31 | 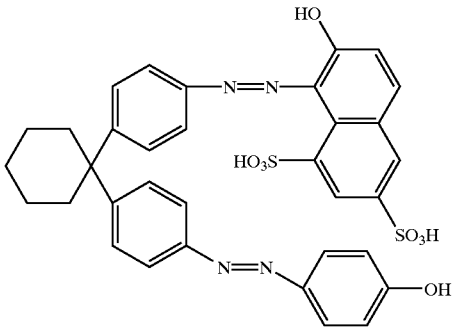 |
| 32 | 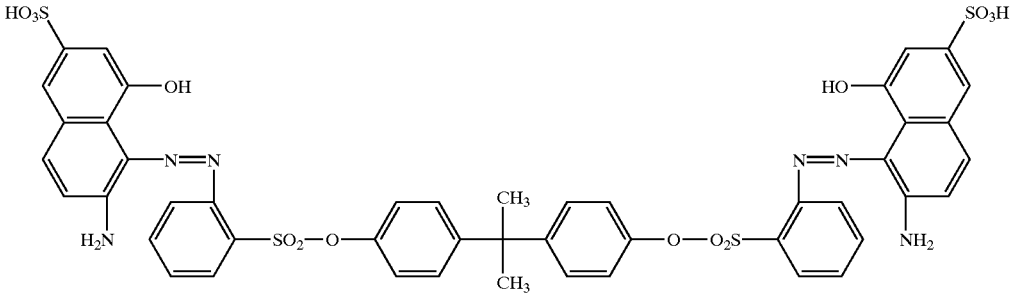 |
| 33 | 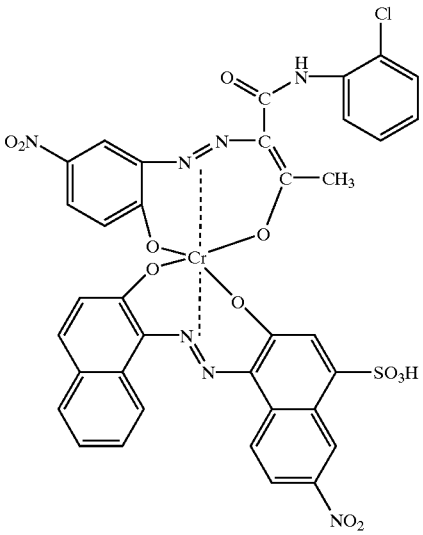 |

TABLE 1-continued

| Example | dye |
|---|---|
| 34 | 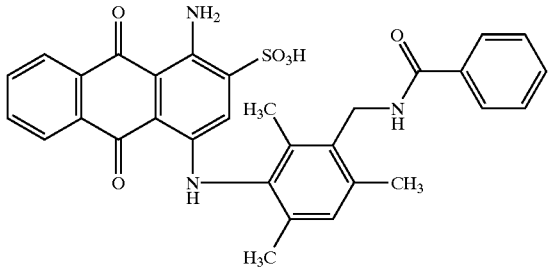 |
| 35 | 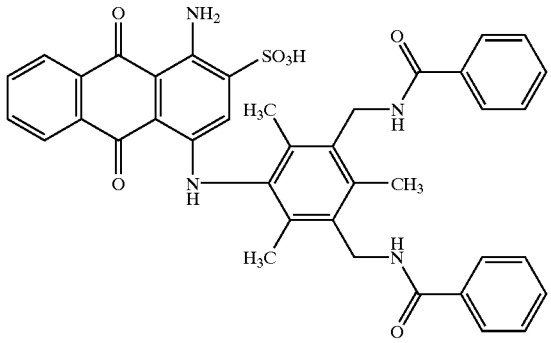 |
| 36 | 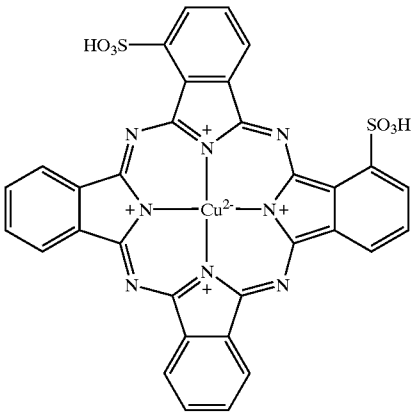 |

Analogous prints are obtained by proceeding as indicated in Examples 2 to 36 but using a bubble jet ink-jet head instead of a piezo ink-jet head.

EXAMPLE 37

Using a drop-on-demand piezo ink-jet head, an ink A according to Example 1c) is used to print a polyamide fabric. The print is dried and fixed in saturated steam at 102° C. and is then washed off, yielding a print having good all-round properties.

Prints having good all-round properties are likewise obtained by proceeding as in Example 37 but using, instead of 5% by weight of the dye indicated therein, an identical amount of one of the dyes listed in Table 1.

EXAMPLE 38

Using a drop-on-demand piezo ink-jet head, an ink A according to Example 1c) is used to print a wool fabric. The print is dried and fixed in saturated steam at 102° C. and is then washed off, yielding a print having good all-round properties.

Prints having good all-round properties are likewise obtained by proceeding as in Example 38 but using, instead of 5% by weight of the dye indicated therein, an identical amount of one of the dyes listed in Table 1.

EXAMPLE 39

An image is digitised by means of a scanner and then stored in a computer. The computer is then used to control an ink-jet printer which prints the image onto a silk fabric pretreated as indicated in Example 1 under a) or b). The printing is carried out as described in Example 1 under c) or d). It is possible to proceed in an analogous manner using one of the inks according to Examples 2 to 36.

EXAMPLE 40

A sheet-form woven silk fabric, which has been pretreated as indicated under a) in Example 1, is conveyed along between two drop-on-demand piezo ink-jet heads, one head being arranged on the upper side of the fabric and the other head being arranged on the underside of the fabric. In this arrangement the upper side of the fabric is printed over the entire surface in one shade, analogously to the directions given under c) in Example 1, while the underside of the fabric is printed with a pattern, analogously to the directions given under c) in Example 1. It is possible to proceed in an analogous manner using one of the inks according to Examples 2 to 36.

EXAMPLE 41

By proceeding as indicated in Example 1c), 1d), 37 or 38 but using, instead of ink A, ink B indicated below having the following composition:

10.0% by weight dye from Example 2, 15.0% by weight ε-caprolactam, 5.0% by weight 1,2-propylene glycol, 0.3% by weight commercially available preservative and 69.7% by weight water, a yellow print having good all-round properties is obtained.

EXAMPLE 42

By proceeding as indicated in Example 1c), 1d), 37 or 38 but using, instead of ink A, ink C indicated below having the following composition:

8.0% by weight dye from Example 3, 10.0% by weight ε-caprolactam, 15.0% by weight 1,2-propylene glycol, 0.3% by weight commercially available preservative and 66.7% by weight water, a turquoise-coloured print having good all-round properties is obtained.

EXAMPLE 43

By proceeding as indicated in Example 1c), 1d), 37 or 38 but using, instead of ink A, ink D indicated below having the following composition:

7.0% by weight dye from Example 17, 10.0% by weight urea, 20.0% by weight glycerol, 0.3% by weight commercially available preservative and 62.7% by weight water, a black print having good all-round properties is obtained.

EXAMPLE 44

By proceeding as indicated in Example 1c), 1d), 37 or 38 but using, instead of ink A, ink E indicated below having the following composition:

6.0% by weight dye from Example 32, 20.0% by weight polyethylene glycol 200, 10.0% by weight N-methylpyrrolidone, 0.3% by weight commercially available preservative and 63.7% by weight water, a red print having good all-round properties is obtained.

EXAMPLE 45

By proceeding as indicated in Example 1c), 1d), 37 or 38 but using, instead of ink A, ink F indicated below having the following composition:

10.0% by weight mixture of the dyes from Examples 34 and 35, 10.0% by weight ε-caprolactam, 5.0% by weight 1,2-propylene glycol, 0.3% by weight commercially available preservative and 74.7% by weight water, a blue print having good all-round properties is obtained.

EXAMPLE 46

By proceeding as indicated in Example 1c), 1d), 37 or 38 but using, instead of ink A, ink G indicated below having the following composition:

3.5% by weight dye from Example 17, 10.0% by weight urea, 20.0% by weight glycerol, 0.3% by weight commercially available preservative and 66.2% by weight water, a grey print having good all-round properties is obtained.

EXAMPLE 47

By proceeding as indicated in Example 1 c), 1 d), 37 or 38 but using, instead of ink A, ink H indicated below having the following composition:

8.0% by weight dye from Example 1c), 15.0% by weight ε-caprolactam, 0.3% by weight commercially available preservative and 76.7% by weight water, a red print having good all-round properties is obtained.

EXAMPLE 48

By proceeding as indicated in Example 1c), 1d), 37 or 38 but using, instead of ink A, ink I indicated below having the following composition:

7.0% by weight dye from Example 31, 15.0% by weight ε-caprolactam, 0.3% by weight commercially available preservative and 77.7% by weight water, an orange print having good all-round properties is obtained.

EXAMPLE 49

By proceeding as indicated in Example 1c), 1d), 37 or 38 but using, instead of ink A, ink J indicated below having the following composition:

5.5% by weight dye from Example 17, 20.0% by weight ε-caprolactam, 10.0% by weight 1,2-propylene glycol, 0.3% by weight commercially available preservative and 64.2% by weight water, a black print having good all-round properties is obtained.

What is claimed is:

1. A process for printing fibrous textile materials using the ink-jet printing technique, wherein the fibrous materials are printed with an aqueous ink that comprises a) at least one acid dye selected from the group consisting of:

disazo dyes of formula (5)

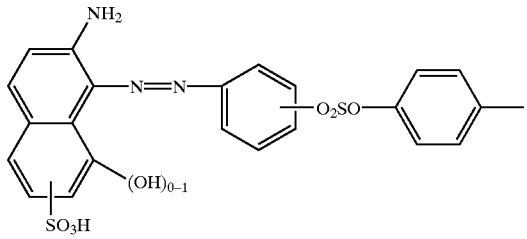

-continued

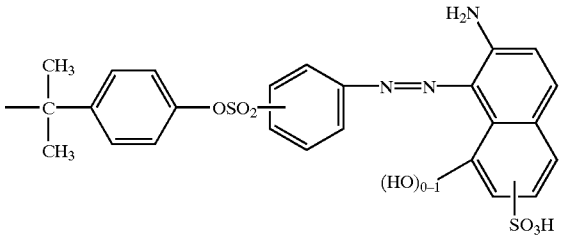

symmetrical 1:2 chromium complex dyes of the azo dyes of formula (8)

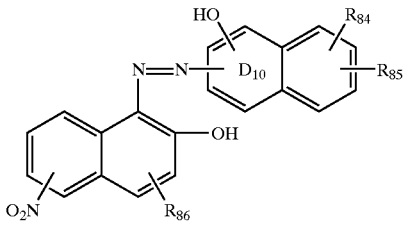

or

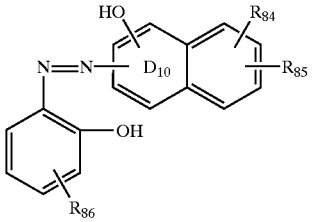

wherein $R_{84}$ is hydrogen, $C_1$–$C_4$alkoxycarbonylamino, benzoylamino, $C_1$–$C_4$alkylsulfonylamino, phenylsulfonylamino, methylphenylsulfonylamino or halogen, $R_{85}$ is hydrogen or halogen and $R_{86}$ is $C_1$–$C_4$alkylsulfonyl, $C_1$–$C_4$alkylaminosulfonyl, phenylazo, sulfo or —$SO_2NH_2$, the hydroxy group in the benzo ring $D_{10}$ being bound in the o-position relative to the azo group on the benzo ring $D_{10}$, copper complex dyes of formula (14)

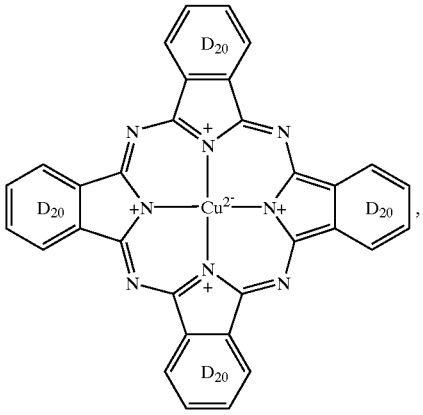

wherein the benzo rings $D_{20}$ are substituted by sulfo or by sulfonamido, metal-free anionic anthraquinone dyes of formula (18)

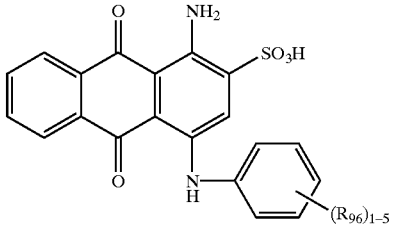

wherein $(R_{96})_{1-5}$ denotes from 1 to 5 identical or different substituents selected from the group consisting of $C_1$–$C_4$alkyl which is unsubstituted or substituted by $C_2$–$C_4$alkanoylamino which is optionally substituted in the alkyl group by halogen; benzoylamino; $C_1$–$C_4$alkoxy; $C_2$–$C_4$alkanoylamino and $C_2$–$C_4$hydroxyalkylsul and disazo dyes of formulae (26)

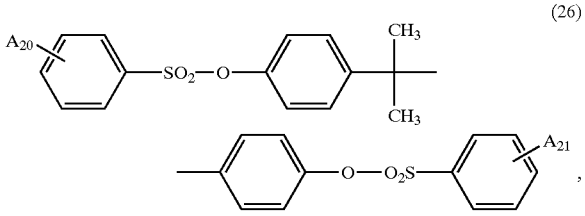

wherein $A_{20}$ and $A_{21}$ are radicals of formula (26a)

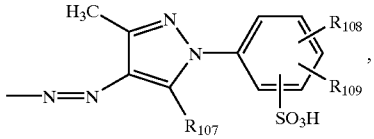

wherein $R_{107}$ is hydroxy or amino and $R_{108}$ and $R_{109}$ are each independently of the other hydrogen or halogen, (27)

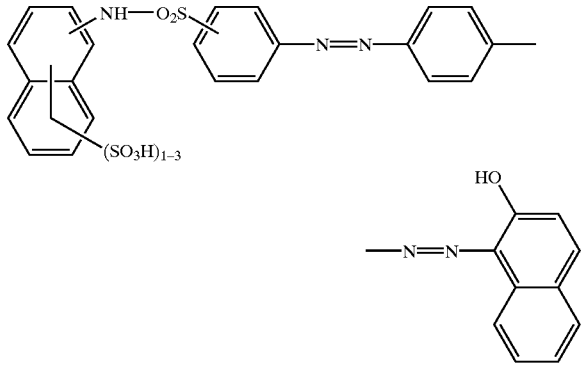

and (28)

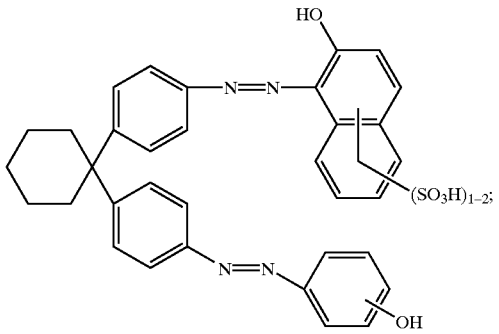

and b) 5 to 20% by weight of ϵ-caprolactam, based on the total weight of the ink; and that has a viscosity of from 1 to 40 mPa·s at 25° C.

2. A process according to claim 1, wherein the ink has a total content of dyes of from 1 to 35% by weight based on the total weight of the ink.

3. A process according to claim 1, wherein the ink has a viscosity of from 1 to 6 mPa·s at 25° C.

4. A process according to claim 1, wherein the ink has a viscosity of from 10 to 30 mPa·s at 25° C.

5. A process according to claim 1, which comprises carrying out drying and fixing of the print after printing, the drying and fixing being carried out continuously.

6. A process according to claim 5, which comprises carrying out the printing, the drying and the fixing of the print continuously.

7. A process according to claim 1, wherein the fibrous textile material is silk or silk-containing fibrous materials.

8. A process according to claim 7, which comprises pretreating the silk or silk-containing fibrous material with an aqueous liquor comprising a thickener and urea.

* * * * *